US007753616B2

(12) United States Patent
Greer et al.

(10) Patent No.: US 7,753,616 B2
(45) Date of Patent: Jul. 13, 2010

(54) SYSTEM, METHOD AND COMPOSITION FOR ADHERING PREFORMED THERMOPLASTIC TRAFFIC CONTROL SIGNAGE TO PAVEMENT

(76) Inventors: Robert F. Greer, 105 Cherokee Dr., Lexington, NC (US) 27295; Alexander F. Cady, 2007 Pepperstone Pl., Apt D, Greensboro, NC (US) 27406

( * ) Notice: Subject to any disclaimer, the term of this patent is extended or adjusted under 35 U.S.C. 154(b) by 648 days.

(21) Appl. No.: 11/643,350

(22) Filed: Dec. 21, 2006

(65) Prior Publication Data

US 2008/0152871 A1 Jun. 26, 2008

(51) Int. Cl.
*E01F 9/04* (2006.01)

(52) U.S. Cl. ..... 404/12; 404/93; 404/94

(58) Field of Classification Search ..... 404/17–94, 404/12

See application file for complete search history.

(56) References Cited

U.S. PATENT DOCUMENTS

| | | | | |
|---|---|---|---|---|
| 2,918,444 | A | 12/1959 | Phillips et al. | |
| 2,921,925 | A | 1/1960 | Phillips et al. | |
| 3,169,945 | A | 2/1965 | Young et al. | |
| 3,318,822 | A | 5/1967 | Batzer et al. | |
| 3,900,687 | A * | 8/1975 | Meader et al. | 428/215 |
| 4,118,376 | A | 10/1978 | Predauin et al. | |
| 4,532,274 | A | 7/1985 | Spurr | |
| 4,539,345 | A | 9/1985 | Hansen | |
| 4,755,575 | A | 7/1988 | Domeier et al. | |
| 4,960,620 | A | 10/1990 | House et al. | |
| 5,173,560 | A | 12/1992 | Gras et al. | |
| 5,302,049 | A * | 4/1994 | Schmanski | 404/42 |
| 5,391,015 | A | 2/1995 | Kaczmarczik et al. | |
| 5,442,034 | A | 8/1995 | Primeaux | |
| 5,759,695 | A | 6/1998 | Primeaux | |
| 5,962,144 | A | 10/1999 | Primeaux | |
| 5,985,986 | A | 11/1999 | Kubitza et al. | |
| 6,096,416 | A | 8/2000 | Altenberg | |
| 6,350,823 | B1 | 2/2002 | Goeb et al. | |
| 6,451,408 | B1 * | 9/2002 | Haunschild et al. | 428/143 |
| 6,479,132 | B2 * | 11/2002 | Hedblom et al. | 428/143 |

(Continued)

FOREIGN PATENT DOCUMENTS

JP 10183783 A2 7/1998

(Continued)

*Primary Examiner*—Raymond W Addie
(74) *Attorney, Agent, or Firm*—Guerry L. Grune; ePatentmanager

(57) ABSTRACT

The present disclosure relates to a system and permanent pavement marker for coating or bonding or both coating and bonding a first underlying substrate, wherein a second layer comprises a polyurea epoxy curable composition of about 200 centipoise which is bonded to the first underlying substrate, wherein the curable composition second layer is further bonded to a third layer, wherein the third layer comprises an epoxy bonder paste in a range of 10,000 to 300,000 centipoise, and the third layer is further bonded to a fourth layer, wherein the fourth layer is a preformed thermoplastic marking tile that is applied over the third layer of epoxy bonder paste, thereby forming a the permanent pavement marking. The system and pavement marker may also include a thermoplastic adhesive applied between the epoxy bonder paste and the preformed thermoplastic marking tile such that the bonder paste acts as a water vapor barrier reducing the rate of water vapor transmission into the marking tile.

26 Claims, 1 Drawing Sheet

U.S. PATENT DOCUMENTS

| | | | | |
|---|---|---|---|---|
| 6,521,718 | B2 | 2/2003 | Goeb et al. | |
| 6,576,074 | B1 * | 6/2003 | Cabrera et al. | 156/71 |
| 6,679,650 | B2 | 1/2004 | Britt et al. | |
| 6,780,459 | B2 | 8/2004 | Macpherson | |
| 6,787,596 | B1 | 9/2004 | Maier et al. | |
| 6,960,989 | B1 * | 11/2005 | Grayson | 340/407.1 |
| 7,142,095 | B1 * | 11/2006 | Grayson | 340/407.1 |
| 2002/0016421 | A1 | 2/2002 | Goeb et al. | |
| 2002/0183450 | A1 * | 12/2002 | Smith | 525/107 |
| 2004/0185231 | A1 | 9/2004 | Dimmick | |
| 2007/0197409 | A1 * | 8/2007 | Scherer et al. | 508/469 |

FOREIGN PATENT DOCUMENTS

| | | | |
|---|---|---|---|
| JP | 03029404 | B2 | 4/2000 |
| WO | WO 03/064771 | A1 | 8/2003 |

* cited by examiner

SYSTEM, METHOD AND COMPOSITION FOR ADHERING PREFORMED THERMOPLASTIC TRAFFIC CONTROL SIGNAGE TO PAVEMENT

This application takes priority from U.S. patent application Ser. No. 11/226,838 and entitled "System, Method, and Composition for Adhering Preformed Thermoplastic Traffic Control Signage to Pavement", filed on Sep. 14, 2005.

FIELD OF INVENTION

The present disclosure relates to a system, method and composition for adhering detectable warning devices, pavement markings, and preformed traffic control devices (turn arrows, stop bars) cured or uncured bituminous or Portland concrete/cement surfaces that are hydrocarbon or alkyd thermoplastic based compositions, to provide permanent pedestrian and traffic control markings.

BACKGROUND OF THE INVENTION

Pavement markings convey information to drivers and pedestrians by providing exposed visible, reflective and/or tactile surfaces that serve as indicia upon a traffic surface. In the past such a function was typically accomplished by painting a traffic surface. Modern pavement marking materials offer significant advantages over paint such as dramatically increased visibility and/or retroreflectance, improved durability, and temporary removable marking options. Examples of modern pavement marking materials are thermoplastic, pavement marking sheet materials, tapes and raised pavement markers.

The Americans with Disabilities Act of 1990, published requirements for sidewalk and other potentially dangerous areas in that detectable warning devices would be required to warn blind or visually impaired and wheelchair bound individuals of potentially dangerous and vehicular traffic areas. Of particular note is section 4.29, §§0.2 as restated below:

4.29 Detectable Warnings

- 4.29.2 Detectable Warnings on Walking Surfaces. Detectable warnings shall consist of raised truncated domes with a diameter of nominal 0.9 in (23 mm), a height of nominal 0.2 in (5 mm) and a center-to-center spacing of nominal 2.35 in (60 mm) and shall contrast visually with adjoining surfaces, either light-on-dark, or dark-on-light. The material used to provide contrast shall be an integral part of the walking surface. Detectable warnings used on interior surfaces shall differ from adjoining walking surfaces in resiliency or sound-on-cane contact.
- 4.29.3 Detectable Warnings on Doors To Hazardous Areas.
- 4.29.4 Detectable Warnings at Stairs.
- 4.29.5 Detectable Warnings at Hazardous Vehicular Areas. If a walk crosses or adjoins a vehicular way, and the walking surfaces are not separated by curbs, railings, or other elements between the pedestrian areas and vehicular areas, the boundary between the areas shall be defined by a continuous detectable warning which is 36 in (915 mm) wide, complying with 4.29.2.
- 4.29.6 Detectable Warnings at Reflecting Pools. The edges of reflecting pools shall be protected by railings, walls, curbs, or detectable warnings complying with 4.29.2.

Detectable warning devices may be constructed as a preformed thermoplastic, thermoplastic, rubber, adhesive tile, tile cast into concrete, metal or other suitable material that will withstand abrasion and environmental extremes.

Formulations for preformed thermoplastic detectable warning devices, pavement markings and traffic control devices (preformed thermoplastic signage) are generically comprised of a:

- Binder (~20%) containing:
  - Resin
    - Maelic modified resin ester
    - C5 hydrocarbon, (for hydrocarbon class)
    - Rosin ester (for alkyd class)
    - Plasticizer
    - Vegetable oils
    - Phthalate esters
    - Mineral oil
    - Castor oil
    - Wax/Flexibilizer
    - Paraffin wax
    - Polyamide
    - EVA or SBS elastomers
- Pigment (2-10%)
  - Titanium dioxide
  - Lead chromate
  - Organic dyes
  - Filler (30-40%)
  - Calcium carbonate
  - Glass beads (30-40%)

wherein the thermoplastic signage may be alkyd or hydrocarbon based. Thermoplastic signage must meet the standard specifications as published in the AASHTO—American Association of State Highway Transportation Officials). Designation: M 249-98

Continuous and skip lane stripings on highways and pedestrian crosswalk markings employ preformed pavement marking sheeting preferably comprising a wear-resistant top layer optionally overlying a flexible base sheet. The top layer is generally highly visible, may include retroreflective elements to enhance detection when illuminated by traffic at night, and serves as indicia when installed upon the roadway surface. Application of temporary pavement marking sheeting to a traffic surface has typically been by contact cement or rubber-based pressure-sensitive adhesives. Traffic surfaces may include surfaces for pedestrians motorized vehicles, aircraft, human powered conveyances, programmable robotics and the like.

Another example of a pavement marking is a raised pavement marker (i.e. a discreet marking structure with a rigid, semi-rigid or flexible marking body) which when applied to a roadway surface provides a raised surface. Often, the raised surface is both reflective and strategically oriented to enhance reflective efficiency when illuminated by traffic at night. In the case of rigid discreet markers, attachment of the body of each marker to the pavement surface has involved hot-melt adhesives or epoxy systems. Flexible body raised pavement markers have also been attached to pavement surfaces or pavement marking sheeting by soft butyl mastic materials.

In order to fulfill their function as indicia, raised thermoplastic detectable warning devices, pavement markers and pavement marking sheeting must be applied to a rather troublesome substrate. That substrate, the traffic surface, varies widely in terms of surface properties because the underlying material may be concrete or asphalt, may be of varying age and temperature, and may, on occasion, be moist or damp or oily. In this specific case, the pavement may still be uncured. Additionally, the roadway surface may vary in texture from rough to smooth. The substrate surface properties, therefore, represent a considerable challenge for attachment.

Specifically the standard for thermoplastic marking bond strength can be found in ASTM D4796-(2004), which states the test method and bonding strength of thermoplastic signage to concrete as: Bond Strength—After heating the thermoplastic material for four hours at 425 degrees F. the bond strength to Portland Cement Concrete shall exceed 1.24 MPa (~180 psi). Preferably the bond strength is from about 200 psi to about 500 psi.

Thermoplastic signage therefore must reach a softening point within a range of about 400 degrees F. to about 450 degrees F. as determined by the ring and ball softening point test method specified in AASHTO Designation: M 249-98, section 12.

Concrete is a mixture of paste and aggregates. The paste, composed of Portland cement and water, coats the surface of the fine and coarse aggregates. Through a chemical reaction known as hydration, the paste hardens and gains strength to form the rock-like mass known as concrete. Within this process lies the key to a remarkable trait of concrete: it is plastic and malleable when newly mixed, strong and durable when hardened. These qualities explain why concrete, can build superhighways, sidewalks, bridges, warehouse flooring and other traffic media.

All Portland cements are hydraulic cements that set and harden through a chemical reaction with water. During this reaction, called hydration, a node forms on the surface of each cement particle. The node grows and expands until it links up with nodes from other cement particles or adheres to adjacent aggregates.

Curing begins after the exposed surfaces of the concrete have hardened sufficiently to resist marring. Curing ensures the continued hydration of the cement and the strength gain of the concrete. Concrete surfaces are cured by sprinkling with water fog, or by using moisture-retaining fabrics such as burlap or cotton mats. Other curing methods prevent evaporation of the water by sealing the surface with plastic or special sprays (curing compounds).

Some of the deficiencies associated with present pavement marking adhesion include the: (1) inability for signage to be adhered to uncured concrete which, depending on conditions, may take from about 8 days to about 21 days up to six months to exhibit a sufficient bonding surface, (2) inability to be applied due to limited adhesive tack at low temperature; (3) limited ability to accommodate surface roughness; (4) reduced durability, particularly at low temperature, when subjected to impact or shear; (5) increasing adhesion over time which in turn limits the duration of a period during which a temporary installation may be efficiently removed; and (6) staining of light colored concrete roadway surfaces by adhesives in removable markers.

Generally, the application of the thermoplastic or preformed thermoplastic signage requires that the concrete substrate be cured minimally from about 8 days to about 21 days before the application of the thermoplastic or preformed thermoplastic signage with some products requiring up to six months. Most preformed thermoplastic signage require the concrete substrate to be preheated to bring the concrete surface substrate up to a required temperature prior to application of the preformed thermoplastic signage. The signage is then heated over the pre-heated concrete surface to melt the signage into the porous surface of the concrete substrate. It is a feature of the present disclosure that preheating and the thermoplastic heating requirement is avoided.

Where the traffic site is newly constructed concrete, the contracted signage application presently adds days to the completion of the project in that the application of thermoplastic detectable warning devices and pavement markers must have a cured surface to adhere to. In most concrete pedestrian traffic areas the concrete is ready for pedestrian traffic from about 72 hours to about 96 hours whereas the signage requires greater curing time for permanent application thereby leaving the traffic area non-ADA compliant.

Laitance (residual from concrete curing process) on the concrete surface must be removed and cleaned prior to application of the thermoplastic signage. Such residual is cleaned from the concrete surface via grinding or high-pressure washing, leaving the concrete top surface wet. Most signage and adhesives require a clean dry surface for preferred adhesion properties. It is also an additional feature of the present invention that laitance removal is not required to establish a good bond to the Portland cement substrate.

Polyurea coatings may also be comprised of aspartic esters which provide amine functionality and a chemical backbone containing amine linkages. Polyurea is generally used as an industrial coating in severe environments such as with wet or damp surfaces with good chemical resistance to hydrocarbons. Polyurea systems may be applied via spray, 2-part caulk, pour, brush-on or other methods known to those skilled in the art.

In many cases, people tend to mix up polyurea coatings and polyurethane coatings. Thus polyurethane coatings have become a generic term for coating systems based on polyisocyanate reactions. Polyurea coatings normally use amines as coreactants to react with isocyanates. This reaction is extremely fast (within a few seconds or minutes). As a result, polyurea coatings tend to have a very limited pot life and their recoat time becomes a problem in cases where multiple coats are required. A polyurea linkage, however, will have better heat and high temperature resistance than a polyurethane system with polyols as coreactants (post-curing).

Polyurea can be defined as the result of a chemical reaction between an isocyanate and an amine. These amines are generally comprised of polyetheramines and a primary amime chain-extender which is used to impart hardblock content and place the formulation on a volume ratio of about 1:1.

This two-component technology is based on an isocyanate quasi-prepolymer and an amine coreactant. Often an amine resin blend polyurea elastomer is made from an (A) component and a (B) component, where the (A) component has a quasi-prepolymer made from an isocyanate and an active hydrogen-containing material, such as a poly-oxyalkylenepolyamine, as described in U.S. Pat. No. 5,442,034 to Dudley J. Primeaux, II of Huntsman Petrochemical Corporation and herein incorporated by reference. The (B) component includes an amine resin, such as an amine-terminated polyoxyalkylene polyol which may be the same or different from the polyoxyalkylene poly-amine of the quasi-prepolymer. The viscosity of the (A) component is reduced by the inclusion of an organic, alkylene carbonate, such as ethylene carbonate, propylene carbonate, butylene carbonate, dimethyl carbonate and the like. The alkylene carbonate also serves as a compatibilizer between the two components, thus provided an improved mix of the system.

Preferably a two-part low viscosity adhesive would comprise a Part (A) component of about 300 centipoise (Cp) and a Part (B) component of about 100 centipoise in an add mixture blend of about 250 centipoise.

U.S. Pat. No. 4,532,274, to Spurr, and assigned to Union Carbide, hereby incorporated by reference, describes epoxied formulations and reactions. An illustration of suitable cycloaliphatic epoxides are as follows:

Formula I

Diepoxides of cycloaliphatic esters of dicarboxylic acids having the formula:

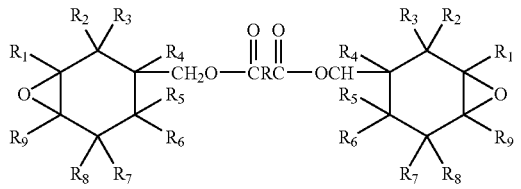

wherein R1 through R9, which can be the same or different are hydrogen or alkyl radicals generally containing one to nine carbon atoms inclusive and preferably containing one to three carbon atoms inclusive as for example methyl, ethyl, n-propyl n-butyl, n-hexyl, 2-ethylhexyl, n-octyl, n-nonyl and the like; R is a valence bond or a divalent hydrocarbon radical generally containing one to nine carbon atoms inclusive and preferably containing four to six carbon atoms inclusive, as for example, alkylene radicals, such as trimethylene, tetramethylene, pentamethylene, hexamethylene, 2-ethylhexamethylene, octamethylene, nonamethylene, and the like; cycloaliphatic radicals, such as 1,4-cyclohexane, 1,3-cyclohexane, 1,2-cyclohexane, and the like.

Particularly desirable epoxides, falling within the scope of Formula I, are those wherein R1 through R9 are hydrogen and R is alkylene containing four to six carbon atoms.

Among specific diepoxides of cycloaliphatic esters of dicarboxylic acids are the following:

bis(3,4-epoxycyclohexylmethyl)oxalate, bis(3,4-epoxycyclohexylmethyl)adipate, bis(3,4-epoxy-6-methylcyclohexylmethyl)adipate, bis(3,4-epoxycyclohexylmethyl)pimelate, and the like. Other suitable compounds are described in U.S. Pat. No. 2,750,395 to B. Phillips et al.

Formula II

A 3,4-epoxycyclohexylmethyl 3,4-epoxycyclohexane carboxylate having the formula:

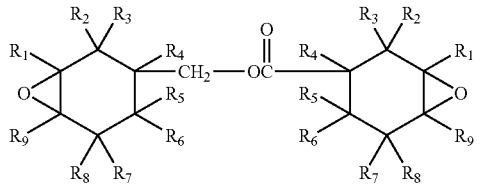

wherein R1 through R9 which can be the same or different are as defined for R1 in formula I. Particularly desirable compounds are those wherein R1 through R9 are hydrogen.

Among specific compounds falling within the scope of Formula II are the following: 3,4-epoxycyclohexylmethyl, 3,4-epoxycyclohexanecarboxylate, 3,4-epoxy-1-methylcyclohexylmethyl, 3,4-epoxy-1-methylcyclohexylmethyl, 3,4-epoxy-1-methylcyclohexanecarboxylate, 6-methyl-3,4-epoxycyclohexylmethyl, 6-methyl-3,4-epoxycyclohexanecarboxylate, 3,4-epoxy-3-methylcyclohexylmethyl, 3,4-epoxy-3-methylcyclohexanecarboxylate, 3,4-epoxy-5-methylcyclochexylmethyl, 3,4-epoxy-5-methylcyclohexanecarboxylate. Other suitable compounds are described in U.S. Pat. No. 2,890,194 to B. Phillips et al.

Formula III

Diepoxides having the formula:

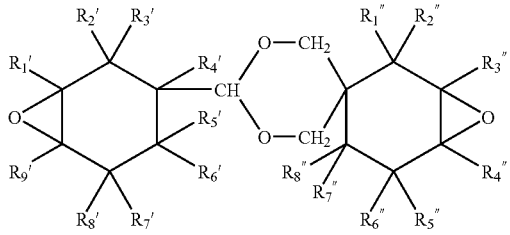

wherein the R single and double primes, which can be the same or different, are monovalent substituents such as hydrogen, halogen, i.e., chlorine, bromine, iodine or fluorine, or monovalent hydrocarbon radicals, or radicals as further defined in U.S. Pat. No. 3,318,822 to Batzer et al. Particularly desirable compounds are those wherein all the R's are hydrogen. Other suitable cycloaliphatic epoxides are the following:

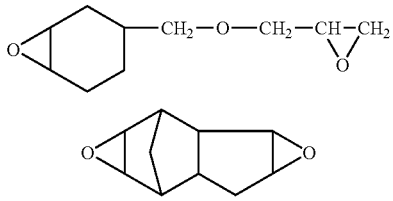

and the like.

The preferred cycloaliphatic epoxides are the following:

3,4-Epoxycyclohexylmethyl-3,4-Epoxycyclohexanecarboxylate

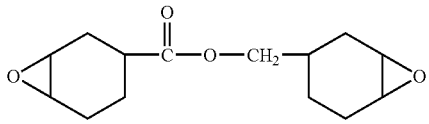

Bis-(3,4-Epoxycyclohexylmethyl) Adipate

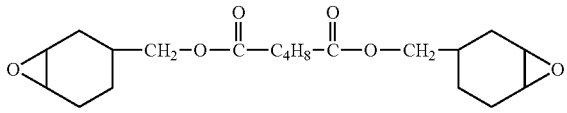

2-(3,4-Epoxycyclohexyl-5,5,spiro-3,4-epoxy) cyclohexane-meta-dioxane

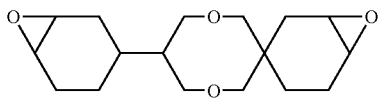

vinyl cyclohexane Dioxide

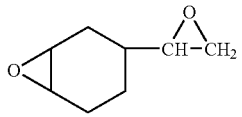

or mixtures thereof.

Epoxides with six membered ring structures may also be used, such as diglycidyl esters of phthalic acid, partially hydrogenated phthalic acid or fully hydrogenated phthalic acid. Diglycidyl esters of hexahydrophthalic acids being preferred. Mixtures of epoxide resins may also be used.

The glycols suitable for use in this invention include polycaprolactone polyols as well as alkylene oxide adducts of polyhydroxyalkanes. Illustrative of the polycaprolactone polyols that can be used one can mention the reaction products of a polyhydroxyl compound having from 2 to 6 hydroxyl groups with caprolactone. The manner in which these polycaprolactone polyol compositions are produced is shown in, for example, U.S. Pat. No. 3,169,945 and many such compositions are commercially available. In the following table there are listed illustrative polycaprolactone polyols. The first column lists the organic functional initiator that is reacted with caprolactone and the average molecular weight of the polycaprolactone polyol is shown in the second column.

Knowing the molecular weights of the initiator and of the polycaprolactone polyol one can readily determine the average number of molecules of caprolactone (CPL Units) that reacted to produce the compound; this figure is shown in the third column.

POLYCAPROLACTONE POLYOLS

| Initiator of polyol in molecules | Average MW | Average No. of CPL Units |
|---|---|---|
| 1 Ethylene glycol | 290 | 2 |
| 2 Ethylene glycol | 803 | 6.5 |
| 3 Ethylene glycol | 2,114 | 18 |
| 4 Propylene glycol | 874 | 7 |
| 5 Octylene glycol | 602 | 4 |
| 6 Decalence glycol | 801 | 5.5 |
| 7 Diethylene glycol | 527 | 3.7 |
| 8 Diethylene glycol | 847 | 6.5 |
| 9 Diethylene glycol | 1,246 | 10 |
| 10 Diethylene glycol | 1,998 | 16.6 |
| 11 Diethylene glycol | 3,526 | 30 |
| 12 Triethylene glycol | 754 | 5.3 |
| 13 Polyethylene glycol (MW 200)* | 713 | 4.5 |
| 14 Polyethylene glycol (MW 600)* | 1,396 | 7 |
| 15 Polyethylene glycol (MW 1500)* | 2,868 | 12 |
| 16 1,2-Propylene glycol | 646 | 5 |
| 17 1,3-Propylene glycol | 988 | 8 |
| 18 Dipropylene glycol | 476 | 3 |

-continued

POLYCAPROLACTONE POLYOLS

| Initiator of polyol in molecules | Average MW | Average No. of CPL Units |
|---|---|---|
| 19 Polypropylene glycol (MW 425)* | 824 | 3.6 |
| 20 Polypropylene glycol (MW 1000)* | 1,684 | 6 |
| 21 Polypropylene glycol (MW 2000)* | 2,456 | 4 |
| 22 Hexylene glycol | 916 | 7 |
| 23 2-Ethyl-1,3-hexanediol | 602 | 4 |
| 24 1,5-Pentanediol | 446 | 3 |
| 25 1,4-Cyclohexanediol | 629 | 4.5 |
| 26 1,3-Bis (hydroxyethyl)-benzene | 736 | 5 |
| 27 Glycerol | 548 | 4 |
| 28 1,2,6-Hexanetriol | 476 | 3 |
| 29 Trimethylolpropane | 590 | 4 |
| 30 Trimethylolpropane | 761 | 5.4 |
| 31 Trimethylolpropane | 1,103 | 8.5 |
| 32 Triethanolamine | 890 | 6.5 |
| 33 Erythritol | 920 | 7 |
| 34 Pentaerythritol | 1,219 | 9.5 |

*= Average molecular weight of glycol.

The structures of the compounds in the above tabulation are obvious to one skilled in the art based on the information given. The structure of compound No. 7 is:

$$HO[(CH_2)_5\overset{\overset{O}{\|}}{C}O]_r CH_2CH_2OCH_2CH_2[O\overset{\overset{O}{\|}}{C}(CH_2)_5]_r OH$$

wherein the variable r is an integer, the sum of r+r has an average value of 3.7 and the average molecular weight is 527. The structure of compound No. 20 is:

$$HO[(CH_2)_5\overset{\overset{O}{\|}}{C}O]_r(C_3H_6O)_n C_3H_6[O\overset{\overset{O}{\|}}{C}(CH_2)_5]_r OH$$

wherein the sum of r+r has an average value of 6 and the average molecular weight of 1,684. This explanation makes explicit the structural formulas of compounds 1 to 34 set forth above.

Illustrative alkylene oxide adducts of polyhydroxyalkanes include, among others, the alkylene oxide adducts of ethylene glycol, propylene glycol, 1,3-dihydroxypropane, 1,3-dihydroxybutane, 1,4-dihydroxybutane, 1,4-1,5- and 1,6-dihydroxyhexane, 1,2-, 1,3-, 1,4-, 1,6-, and 1,8-dihydroxyoctane, 1,10-dihydroxydecane, glycerol, 1,2,4-trihydroxybutane, 1,2,6-trihydroxyhexane, 1,1,1-trimethylolethane, 1,1,1-trimethylolpropane, pentaerythritol, caprolactone, polycaprolactone, xylitol, arabitol, sorbitol, mannitol, and the like; preferably the adducts of ethylene oxide, propylene oxide, epoxybutane, or mixtures thereof. A preferred class of alkylene oxide adducts of polyhydroxyalkanes are the ethylene oxide, propylene oxide, or mixtures thereof, adducts of trihydroxyalkanes. The preferred alkylene oxide adducts of polyhydroxyalkanes are of the following formula:

$$R_{10}\text{—}[O(CH_2\text{—}\underset{\underset{CH_3}{|}}{CH}\text{—}O)_n H]_3$$

wherein R10 is alkane of 3 to 10 carbon atoms, preferably 3 carbon atoms, and n is an integer of from about 4 to about 25.

It is customary to add appropriate hardeners to epoxide compositions to effect cure. Among suitable hardeners are the following: 1. polybasic acids having at least 2 carboxylic acid groups per molecule. 2 anhydrides of acids having at least 2 carboxylic acid groups per molecule.

Illustrative of suitable polybasic acids are the polycarboxylic acids of the formula: HOOC—$(CH_2)_f$—COOH wherein f is an integer generally having a value of from 1 to 20 inclusive, as for example, malonic, glutaric, adipic, pimelic, suberic, azelaic, sebacic and the like. Other examples of suitable acids are phthalic acid, isophthalic acid, terephthalic acid, hexahydrophthalic acid, and the like. Further acids are enumerated in U.S. Pat. No. 2,918,444 to B. Phillips et al.

Among other suitable polybasic acids, having at least two carboxylic groups per molecule, can be noted the following: tricarballylic acid, trimellitic acid and the like. Other such suitable polybasic acids, including polyesters thereof, are described in U.S. Pat. No. 2,921,925 to B. Phillips et al. Suitable anhydrides are the anhydrides of the acids listed above.

For purposes of stoichiometric calculations with respect to acids, one carboxyl group is deemed to react with one epoxy group; with respect to anhydrides, one anhydride group is deemed to react with one epoxy group.

Preferred hardeners include methyltetrahydrophthalic anhydride, hexahydrophthalic anhydride and methylhexahydrophthalic anhydride.

In an embodiment of this invention, the hardener such as the anhydride may be reacted with the glycol and this reacted product added to the epoxide.

It is to be understood that other additives can be added to the compositions of this invention as is well known in the epoxy art. These additives include the following: modifiers such as dimer acid (made from unsaturated $C_{18}$ fatty acids and is a mixture of 3 percent mono basic acids, 75 percent dimer acid and 22 percent trimer acid and sold under the name of Empol 1022 by Emery Industries), a carboxyl terminated butadiene acrylonitrile (80-20) random copolymer having a molecular weight of about 3300; fillers such as clay, silica, aluminum trihydride, or mixtures thereof which may be coated with, for example, silanes, which fillers may be added in amounts of up to about 60 percent; pigments such as carbon black; mold release agents, and the like.

The compositions of this embodiment are prepared by simply mixing the epoxide, glycol, catalyst, hardener and other ingredients at room or higher temperatures in a suitable container. Also, the epoxide and glycol may be mixed in one container and the hardener, catalyst and/or accelerator in another container and these two mixed.

The composition is then heated in order to effect its cure. The temperature to which the composition of this invention are heated to effect cure will, of course, vary and depend, in part upon the exact formulations of the composition. Generally, temperatures in the range of about 100.degree. C. to about 200.degree. C. are used for a period of time ranging from about 1 to about 6 hours.

The compositions of this invention are preferably used to fabricate thermoset resin articles by the procedure as set forth in U.S. Pat. No. 4,755,575, filed in the names of Domier, et. al., titled "A Process For Fabricating Thermoset Resin Articles" and filed on the same data as this application. The process described in said U.S. Pat. No. 4,755,575 comprises the steps of (a) providing in an accumulator zone, a liquid body of an epoxide containing organic material which is curable upon heating to a thermoset resin composition, the viscosity of said liquid body being maintained essentially constant in the accumulator zone by keeping its temperature below that at which curing of said materials is substantial, (b) providing a heated closed mold from which essentially all of the air has been removed from the cavity in said mold, (c) injecting at least a portion of said liquid body under pressure into the closed mold to fill the cavity in the mold, (d) initiating the curing of said materials by subjecting the materials to a temperature in the mold above the temperature at which the curing of said materials is initiated, (e) maintaining a pressure on the curing material, (f) injecting additional of said materials to the mold cavity during the curing of said materials, and (g) opening said mold and removing the article therefrom.

Other processes known in the art may be used to formulate the compositions of this invention.

EXAMPLES

The following Examples serve to give specific illustration of the practice of this invention but they are not intended in any way to act to limit the scope of this invention.

The following designations used in the Examples have the following meanings:

Epoxy 1=3,4-epoxycyclohexyl-3,4-epoxycyclohexane carboxylate

HHPA=hexahydrophthalic anhydride

ATH=aluminum trihydrate treated with a 1% by weight of a mixture of one part of beta(3,4-epoxycyclohexyl) ethyltrimethoxysilane and three parts of n-octyltriethoxysilane.

Polyol 1=polycaprolactone polyol having a molecular weight of 1250.

Polyol 2=polypropylene oxide triol having a molecular weight of 710.

Polyol 3=polypropylene oxide triol having a molecular weight 5000.

Catalyst 1=benzyl dimethyl amine.

Catalyst 2=2-methylimidazole.

Catalyst 3=the reaction product of imidazole and propylene oxide.

Catalyst 4=2-phenyl-imidazole.

Catalyst 5=1-vinyl-2-methylimidazole.

Catalyst 6=1,4-diazobicyclo[2.2.2]octane.

Catalyst 7=1-methylimidazole.

Catalyst 8=a mixture of 70 percent of bis(dimethylamino ethyl ether) and 30 percent dipropyleneglycol.

Catalyst 9=bis(dimethylamino ethyl ether).

Catalyst 10=n-propyl triphenyl phosphonium bromide.

Preparation of Formulations

In preparation for incorporation into a formulation, the filler was dried for about 12 hours in an air oven at 100.degree. C. The other ingredients were separately heated to 80.degree. C. in an air oven for about 30 minutes just prior to use. When used, solid catalysts were dissolved by stirring them into the anhydride during the period the ingredients are heated to 80.degree. C.

Liquid components of a formulation which were heated to 80.degree. C. were rapidly mixed together by hand and the filler was rapidly stirred into the liquid composition. A timer was started to record pot-life data. The hand mixed composition (about 2 pounds total weight) was sheared on a Cowles Dissolver for 60 seconds and then placed in a large vacuum chamber. The pressure was reduced to about 30 inches of mercury (as read on a mechanical gauge) to de-aerate the mix. The vacuum was released as soon as the foam head which had formed collapsed, as seen through a viewpoint on the vacuum chamber. The time required for this procedure beginning with the starting of the time was about five minutes. The temperature of the formulation at this point was usually 80.degree.+−0.2.degree. C.

One half of the mix was immediately poured into an aluminum cavity mold which was pre-heated to 150.degree. C., (the mold cavity is 2 inches in diameter and 2½ inches deep, the walls are 1 inch thick). The mold was situated in a circulating air oven at 150.degree. C. The temperature of the mold was monitored by a thermocouple placed mid-way in the mold wall. After filling the mold to within about ¼ inch to ½ inch from the top, an aluminum cap (at 150.degree. C.) was placed over the mold. The cap held a thermocouple in its center which protruded to the center of the formulation (1 inch from the mold wall and bottom inside surfaces). A strip recorder was used to follow the exotherm profile. Immediately after filling the mold cavity, the other half of the formulation was poured into an 8 ounce metal can. The can was placed in a circulatory silicone oil bath at 80.degree. C. A Brookfield viscometer (Model HAT, Spindle N. 4, 20 RPM) was used to follow the viscosity of the formulation with time. The first viscosity reading was routinely taken six minutes after the start of the time noted above.

Pot-life was measured by the time for the formulation to reach a specific viscosity at 80.degree. C. (3000 centipoise and 20,000 centipoise). Cure speed was measured by the time from mold fill to peak exotherm in the 150.degree. C. cavity mold. Peak exotherm temperature was also recorded.

Control A and Examples 1 to 7

The ingredients in Table I were formulated as described in Preparation of Formulations, supra and tested as described above. The test results are shown in Table II.

TABLE I

| | Example* | | | | | | | |
|---|---|---|---|---|---|---|---|---|
| | Control A | 1 | 2 | 3 | 4 | 5 | 6 | 7 |
| Epoxy I | 80 | 80 | 80 | 80 | 80 | 80 | 80 | 85 |
| Polyol I | 20 | 20 | 20 | 20 | 20 | 20 | 20 | 35 |
| HHPA | 70.4 | 70.4 | 70.4 | 70.4 | 70.4 | 70.4 | 70.4 | 73.33 |
| Catalyst | | | | | | | | |
| Type | Catalyst 1 | Catalyst 2 | Catalyst 2 | Catalyst 3 | Catalyst 4 | Catalyst 5 | Catalyst 6 | Catalyst 6 |
| Amount | 3.4 | 1.7 | 0.42 | 1.7 | 1.7 | 1.7 | 0.85 | 0.87 |
| ATH | 260.7 | 258.2 | 258.2 | 258.2 | 258 | 258 | 257 | 261.3 |

*All numbers represent parts by weight

TABLE II

| | Example | | | | | | | |
|---|---|---|---|---|---|---|---|---|
| | Control A | 1 | 2 | 3 | 4 | 5 | 6 | 7 |
| Time for Viscosity to reach 3000 centipoise at 80° C. (mm) | 75 | 36 | 62 | 32 | 100 | 47 | 34 | 57 |
| Gel time at 150° C. (mm) | 9 | 5 | 6 | 4 | 9.5 | — | | 42 |
| Time to peak Exotherm (mm) | 15.5 | 10.0 | 84 | 8.8 | 103 | 7.3 | 87 | 9.0 |
| Peak Exo therm (° C.) | 188 | 210 | 200 | 207 | 208 | 206 | 187 | 189 |

Examples 8 to 12

The ingredients in Table III were formulated as described in Preparation of Formulations, supra, and tested as described above. The test results are shown in Table IV.

TABLE III

| | Example* | | | | |
|---|---|---|---|---|---|
| | 8 | 9 | 10 | 11 | 12 |
| Epoxy I | 80 | 80 | 80 | 80 | 80 |
| Polyol II | 10 | 10 | 10 | 10 | 10 |
| Polyol III | 10 | 10 | 10 | 10 | 10 |
| HHPA | 70.4 | 70.4 | 70.4 | 70.4 | 70.4 |
| Catalyst | | | | | |
| Type | Catalyst 6 | Catalyst 7 | Catalyst 8 | Catalyst 9 | Catalyst 10 |
| Amount | 0.85 | 0.43 | 1.7 | 1.7 | 0.85 |
| ATH** | 256 | 256 | 256 | 256 | 256 |

*All numbers represent parts by weight
**The ATE was untreated

TABLE IV

| | Example | | | | |
|---|---|---|---|---|---|
| | 8 | 9 | 10 | 11 | 12 |
| Time for viscosity to reach 20,000 centipoise at 80° C. (mm) | 57 | 84 | 90 | 64 | 70 |
| Time to peak Exotherm (mm) | 9.8 | 10.3 | 9.9 | 9.7 | 8.0 |
| Peak Exotherm (° C.) | 189 | 201 | 198 | 196 | 198 |

Zumar Signs, a company that provides road signage, teaches away from using an adhesive and relies on heat only. Zumar markets Stimsonite (now Zumar) Hot Tape which claims the following advantages:

Year-round application in temperatures as low as 32 F

No primers or adhesives required

Excellent retroreflectivity by incorporating both large and normal size glass beads No cracking due to material contracting or expanding Impervious to vehicle oil and grease Environmentally safe: contains no VOCs; no primers/adhesives; lead free pigments No heavy thermoplastic application equipment Bonds to all primary substrates such as asphalt, concrete and brick Easily checked for bond Flexible and uniform pre-beading for easier handling and installation Available in 90 and 120 mil thicknesses 90 mil straight lines are available in rolls for yellow and white; all other items are shipped in 3-ft. lengths Standard colors: White, Yellow, Blue and Black All standard legends and symbols comply with MUTCD standards and widths The practical significance of deficiencies of providing an adhesive system includes a tendency towards either inadequate initial bonding (i.e. through insufficient adhesive tack), inadequate permanent bonding of a marking sheet to the traffic surface, the requirement to preheat the pavement, poor bond on Portland cement concrete which has not dried out or cured sufficiently, or poor bond on Portland cement concrete surfaces where the laitance has not been removed. Some pavement marking sheets have a somewhat elastic nature and their slow but progressive tendency toward recovery after initial application may exceed adhesive forces bonding the sheet to the pavement and result in the pavement marking sheet becoming detached. Once the pavement marking sheet becomes prematurely detached from a roadway surface, advantages such as more effective visibility and potentially longer service life cannot be realized. Further, inadequate adhesive tack at low temperature limits the application season in many locations which in turn leads to less efficiently marked traffic projects.

In view of the above-described deficiencies associated with adhesion of detectable warning devices or pavement marking sheets or raised pavement markers to roadway surfaces, a desirable adhesive method would embody the following properties:

1. Extended temperature range for application.

2. Durability of application/adhesion.

3. Acceptable cost.

4. Efficient installation.

5. No preheating requirement.

6. No laitance removal on Portland cement concrete.

7. No drying of the Portland cement concrete.

8. Ability to adhere to uncured Portland cement concrete.

The present disclosure satisfies these requirements with a method for applying thermoplastic (preformed) detectable warning devices and pavement markings to uncured concrete thereby speeding construction processes, enabling a more rapid compliance for ADA regulations and potentially reducing construction schedules.

DESCRIPTION OF PRIOR ART

U.S. Pat. No. 4,532,274 to Spurr, and assigned to Union Carbide, describes a curable molding composition comprising an epoxide resin, a polyol, a hardener, and a catalyst selected from the group consisting of amine, quaternary ammonium or phosphonium compounds characterized by a peak exotherm of 210° C. or less which is generally an epoxy composition that is heat curable. This invention is in regards to a curable composition and does not enter make any method claims in regards to a specific substrate. The present invention utilizes a similar composition for a concrete substrate wherein a thermoplastic composition may be placed and adhered utilizing heat.

U.S. Pat. No. 6,096,416 to Altenberg, describes a poured-in-place sandwich panel utilizing a polyisocyanurate or polyurethane foam core containing glass fibers to mate two metal panels together. This invention exhibits the use of polyurea in fastening surfaces together however is specific to adhering metal panels together.

U.S. Pat. No. 5,759,695 to Primeaux, and assigned to Huntsman Chemical, and hereby fully incorporated by reference, describes a polyurea elastomer system with improved adhesion to a substrate with the use of a primer that is applied first wherein the primer is a separate step prior to the application of the polyurea elastomer. The primer is composed of hydrophobic, primary hydroxyl-containing compound, for example, castor oil, and an isocyanate. A polyurea elastomer is applied over the primer which is adhered to substrates such as concrete, wood, metal, asphalt, plaster, tile, mortar, grout, and brick. The primer and elastomer are essential for strengthening the surface of the substrates and curing does not involve application of heat.

U.S. Pat. No. 5,962,144 to Primeaux, and assigned to Huntsman Chemical, also hereby fully incorporated by reference, is a continuation of U.S. Pat. No. 5,759,695 and describes an improved primer/elastomer formulation wherein regardless of whether the substrate is dry or wet, adhesion is improved utilizing normal curing.

U.S. Pat. No. 6,780,459 to Macpherson, describes a method for stabilizing irregular rock, concrete and molding tool structures, the method comprising concurrently heating and mixing a mixture of polyoxypropylene diamine with an aromatic diamine liquid in about a 2:1 to 1:1 ratio mechanically purging the mixture under pressure and combining a polyurea mixture with fibrous mesh, foam or geotextile mat for stability. This invention demonstrates viability to coat irregular and uneven, however combines polyurea and material that is spray applied to a surface for strengthening a surface. The present invention utilizes the application of a polyurea elastomer to irregular concrete traffic surfaces and applying thermoplastic signage to the polyurea elastomer and curing and bonding the signage to the polyurea elastomer and concrete substrate by the use of heat.

U.S. Pat. No. 4,539,345 to Hansen, and assigned to 3M Innovative Properties Company, hereby incorporated by reference describes a one-part moisture-curable polyurethane composition and a method whereby for coating a first substrate, or for bonding a second substrate thereto, comprising the steps of applying to said first substrate a layer of one-part moisture-curable polyurethane optionally applying said second substrate to said layer, and allowing said composition to cure.

U.S. Pat. No. 5,391,015 to Kaczmarczik, et. al., and assigned to 3M Innovative Properties Company, describes a pavement marker having an upper surface and comprising a bottom layer of polyorganosiloxane pressure-sensitive adhesive and the roadway surface has a temperature below 15 degree. C. This invention is for a pavement marker with a pressure sensitive adhesive applied to the pavement marker. The method of applying the pavement marker does not involve the application of polyurea to the substrate or of applying heat to the marker to bond the marker to the traffic surface.

U.S. patent application No. 20040185231A1 to Dimmick, describes a method of coating a substrate surface such as concrete and with a polymer base coat on the substrate surface, placing a printed sheet on at least a portion of the base coat and applying a polymer top coat on the printed sheet and allowing the layers to cure. This invention does not use heat to bond the printed sheet material to the polyurea or the substrate. Additionally it requires the application of at least one clear polymer topcoat over the printed sheet material. The present invention does not require the application of a clear polymer topcoat over the printed pavement marking and the sealing of the printed pavement marking is by the application of heat to the printed pavement marking surface.

U.S. Pat. No. 5,173,560 to Gras, et. al., and assigned to Huels Aktiengesellschaft, describes a cold-curing, solvent-free, duroplastic two- or one-component polyurethane-polyurea compound wherein the composition provides coating, sealing, or encapsulating a substrate. This invention relates to a polyurea/polyurethane formulation. The present invention acknowledges the need for a commercially available polyurea/polyurethane formulation to adhere to the concrete substrate and to chemically bond to the thermoplastic printed pavement marking and the concrete substrate when heat is applied thereto.

U.S. Pat. No. 6,787,596 to Maier, et. al., and assigned to S K W Bauchemie, GmbH, describes a solvent-free polyurethane-polymer hybrid dispersion having a high solids content of polymer or formulation constituents. The polyurethane-polymer hybrid dispersion proposed according to the invention can be used in an outstanding manner in formulations for sport floor coverings. This invention demonstrates the ability for polyurethane-polymer uses for sealing and strengthening concrete surfaces other than traffic surfaces. The present invention teaches to the application of printed sheets of thermoplastic pavement markings to concrete traffic surfaces but does not exclude the application of thermoplastic markings to concrete other than conventional traffic surfaces.

U.S. Pat. No. 5,985,986 to Kubitza, et. al., and assigned to Bayer Atkiengesellschaft, describes a process for the preparation of a coating which comprises applying to a water-resistant substrate an aqueous coating composition containing water and only one binder and curing said aqueous coating composition in the presence of moisture to form a polyurea coating. The present invention acknowledges the need for a commercially available polyurea/polyurethane formulation to adhere to the concrete substrate and to chemically bond to the thermoplastic printed pavement marking and the concrete substrate when heat is applied thereto.

U.S. Pat. No. 6,679,650 to Ennis Paint includes the development of a thermoplastic contrast marking (black/white). The patent includes an example of a generic formulation that is similar to the present invention.

PCT application WO 03/064771 A1 to Avery Dennison requires using a structural adhesive for sealing the perimeter edge of a pavement marking. This invention, however, teaches away from the present invention in that it provides for the distinction that penetration of the concrete surface occurs due to a lower viscosity. Additionally, recommendations in the application are provided regarding the use of a caulking gun (implying high viscosity) for the recommended structural adhesives. No mention of detectable warning products is provided anywhere in the application.

U.S. Pat. No. 4,960,620 to House, et. al., and assigned to UOP, describes a method for coating or patching pavement with a polyurethane or polyurea composition and a primary amine-free curing composition that will react at ambient conditions to form said polyurethane or polyurea composition. This invention teaches the use of secondary diamines that act as chain extenders with urethane prepolymers as generally effective curing agents for a broad range of urethane prepolymers at elevated temperatures. The present invention allows for the use of commercially available polyureas as a coating agent on the substrate whereby the thermoplastic pavement marking is applied and heat is introduced to bond the thermoplastic pavement marking, polyurea and concrete substrate.

This inventive concept is not useful for green or uncured concrete.

Recently, certain secondary diamines have been found to have an acceptably long pot life, and act as chain extenders with urethane prepolymers. Such secondary diamines as N,N'-dialkyl-4,4'-methylene-dianilines, N,N'-dialkyl-phenylene-diamines, and polyfunctional oligomers based thereon, are generally effective curing agents for a broad range of urethane prepolymers at elevated temperatures.

U.S. Pat. No. 6,350,823 to Goeb, et. al., and assigned to 3M Innovative Properties Company, describes a pavement marking composition comprising (a) a polyfunctional ethylenically unsaturated polymer selected from the group consisting of polyfunctional ethylenically unsaturated polyureas, polythiocarbamateureas, and polyurethaneureas comprising at least one aspartic ester polyaimine-derived segment and at least one polycarbonate, polyether, or polyester segment; and (b) at least one ethylenically unsaturated monomer. This invention describes the actual pavement marking and a process using a polyfunctional ethylenically unsaturated polymer to attach the pavement marking to a traffic surface wherein the composition further comprises a curing system, filler, pigment, and/or reflective elements. The invention teaches away from using heat as a curing system to adhere the pavement marking to the traffic surface.

Relative to known liquid pavement marking compositions, the pavement marking composition of one embodiment provides durably bondable pavement markings that surprisingly exhibit both improved cold impact (snow plow) resistance and improved wear resistance, even though these characteristics are generally difficult to simultaneously achieve and/or enhance. The composition can be easily applied (e.g., by hand using a trowel or a drawbox or by spraying), without the need for expensive and/or bulky heating equipment, and cures in a reasonable amount of time at any of a wide range of commonly-encountered temperatures. Furthermore, since the composition does not contain either solvent or reactive isocyanate (nor, in preferred embodiments, low molecular weight monomer), it can be safely handled with reduced inhalation risk and environmental hazard. With a PSA system, one uses a high molecular weight polymer with a low glass transition temperature to bond to the substrate surface. In this type of system there is no penetration into or through a Portland cement pavement substrate. The typical application method is to use heat to apply the adhesive. There are also durability issues with this type of system when exposed to shear vs. that of a thermoplastic system.

In using a thermoplastic adhesive system, one applies enough heat to the adhesive to melt or flow the material onto the pavement surface. In this system as well, there is no penetration into or through a Portland cement pavement substrate. Once the heat is removed, the adhesive cools and is bonded to the pavement surface. In this type of system, adhesives that have a glass transition temperature higher than ambient can be used.

U.S. Pat. No. 6,521,718 to Goeb, et. al., and assigned to 3M Innovative Properties Company, is a continuation of U.S. Pat. No. 6,350,823 and describes a pavement marking composition comprising a polyfunctional ethylenically unsaturated polymer selected from the group consisting of polyfunctional ethylenically unsaturated polyureas, polythiocarbamateureas, and polyurethaneureas comprising at least one aspartic ester polyaimine-derived segment and at least one polycarbonate, polyether, or polyester segment and at least one ethylenically unsaturated monomer. The invention teaches away from using heat as a curing system to adhere the pavement marking to the traffic surface.

U.S. patent application No. 20020016421A1 to Goeb, et. al., and assigned to 3M Innovative Properties Company, describes a pavement marking composition and adhesive with reduced inhalation or environmental risk. The invention teaches away from using heat as a curing system to adhere the pavement marking to the traffic surface.

U.S. Pat. No. 4,118,376 to Predain, et. al., and assigned to Bayer Atkiengesellschaft, describes an adhesive mixture formulation that is hardenable by water which, in an of itself, lends to the use of polyisocyanate component, isocyanate-containing prepolymers based on organic polyisocyanates and dispersions of polymers, polycondensates or polyaddition products in organic polyhydroxyl compounds in areas where moisture is inherently present. The present invention recognizes these compositions and utilizes them to create a hardenable surface in an uncured concrete substrate for the application of thermoplastic pavement markings recognizing that by the application of heat, the thermoplastic pavement markings and the polymers will bond with the uncured concrete forming a bonded surface of all three components.

Japanese Patent Application No. JP10183783A2 (and most recently JP03029404B2) to Iizuka, et. al., and assigned to San Techno Chemical KK, describes a polyurea resin coating layer which is formed on the surface of concrete in the wet state to integrate a water proof film with hard concrete. This processing is preferably conducted for concrete within 7 days after placing. Further a primer layer may be formed on the concrete surface and then a polyurea resin coating layer may be formed, and further the polyurea resin coating layer may be formed without formation of a primer layer. In this case, the primer may be one kind, a single, or two or more kinds of primers may be combined, and they contain an epoxy resin composition or a polyurethane resin composition. The application does not include any discussion or application for detectable warning devices or the use of heat treating to complete the process.

DETAILED DESCRIPTION OF THE DRAWINGS

Figure 1A:
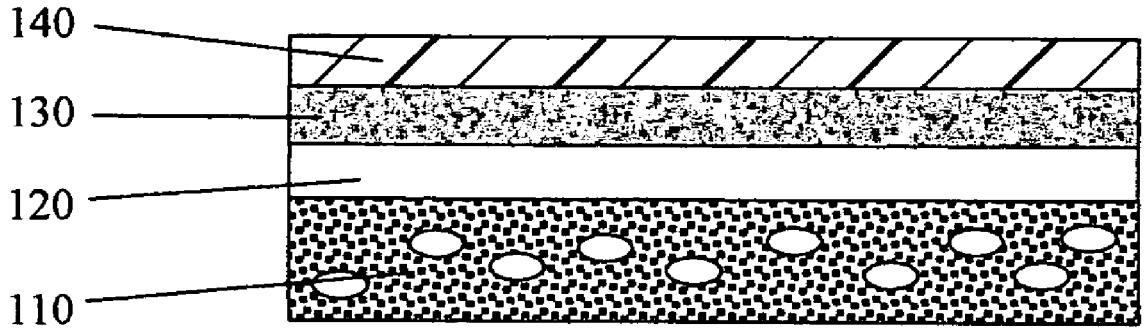
FIG. 1A is a cross section of an embodiment of the disclosure comprising four distinct layers.

FIG. 1A is a cross section of the disclosure showing a layer or substrate of concrete [110] which may be cured or uncured. The surface of the concrete [110] was then coated with a polyurea epoxy primer [120]. The polyurea epoxy primer [120] possesses a relatively low viscosity of approximately 200 centipoise (cP). The third layer which was applied over the polyurea epoxy primer [120] is an epoxy bonder paste [130] that is characterized by a viscosity of 10,000 to about 300,000 cP. A fourth layer comprising a preformed thermoplastic marking tile [140] was then applied over the epoxy bonder paste [130] forming a permanent pavement marking.

Figure 1B:
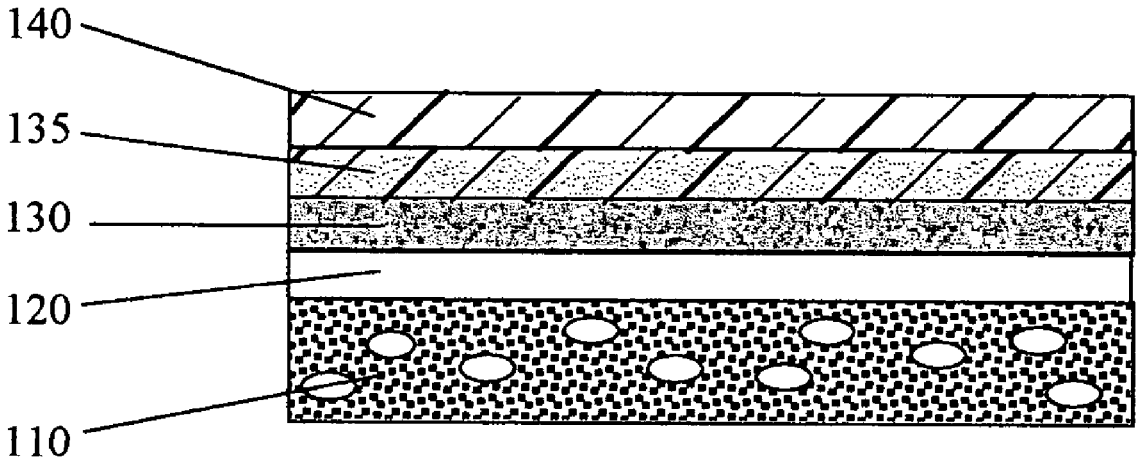
FIG. 1B is a cross section of an embodiment of the disclosure comprising an additional layer of thermoplastic adhesive.

FIG. 1B is a cross section of another embodiment wherein a layer of thermoplastic adhesive [135] was applied between the epoxy bonder paste [130] and the preformed thermoplastic marking tile [140].

SUMMARY OF INVENTION

The present disclosure relates to a system, a method and composition for adhering thermoplastic detectable warning tiles, detectable warning devices, pavement markings and preformed traffic control devices (turn arrows, stop bars) that are hydrocarbon or alkyd in nature to a layer or substrate such as a concrete traffic surface to provide permanent pedestrian and traffic control markings.

In an embodiment a concrete surface is prepared with an epoxy primer to (fix) stabilize the concrete surface and an epoxy bonder paste is applied to the primed surface and subsequently the thermoplastic adhesive and thermoplastic detectable warning device, pavement marking and/or preformed traffic control device are applied onto the epoxy bonder paste surface.

In another embodiment the epoxy primer used to seal the concrete surface is of about 200 cP. The epoxy bonder paste has a viscosity of 10,000 to 300,000 cp forming a thicker adhesive layer on which to adhere a preformed thermoplastic adhesive layer, thermoplastic detectable warning device, pavement marking and/or preformed traffic control device.

In an additional embodiment the composition and system components of a concrete surface, a polyurea primer, an epoxy paste and a thermoplastic marking tile, thermoplastic detectable warning device, pavement marking and/or preformed traffic control device does not require heat as a catalyst to bond the components together.

An additional embodiment relates to a system, method and composition for adhering thermoplastic marking tile, preformed thermoplastic detectable warning devices, pavement markings and preformed traffic control devices (generally known as thermoplastic signage) to uncured, or "green" concrete by coating the uncured concrete with a commercially available low viscosity polyurea epoxy primer composition, applying an epoxy bonder paste, applying a thermoplastic adhesive layer and laying a sheet of preformed thermoplastic marking tile, thermoplastic signage, preformed thermoplastic detectable warning devices, pavement markings and preformed traffic control devices over the epoxy bonder paste surface, binding the combination of the concrete, epoxy primer, the epoxy paste, thermoplastic adhesive and the preformed thermosplastic signage into a single semi-homogeneous concrete surface and substrate. The present invention does not require preheating of Portland cement concrete or asphaltic pavement surface. It does not require removal of laitance on Portland cement concrete, it also can be used on Portland cement concrete that remains moist throughout its lifetime due to lack of water drainage in the surrounding area.

An additional embodiment relates to a system, method and composition for adhering thermoplastic marking tile, preformed thermoplastic detectable warning devices, pavement markings and preformed traffic control devices (generally known as thermoplastic signage) to uncured, or "green" concrete by coating the uncured concrete with a commercially available low viscosity polyurea epoxy primer composition, applying an epoxy bonder paste and laying a sheet of preformed thermoplastic marking tile, thermoplastic signage, preformed thermoplastic detectable warning devices, pavement markings and preformed traffic control devices over the epoxy bonder paste surface, binding the combination of the concrete, epoxy primer, the epoxy paste and the preformed thermoplastic signage into a single semi-homogeneous concrete surface and substrate by omitting the fourth substrate. The present invention does not require preheating of Portland cement concrete or asphaltic pavement surface. It does not require removal of laitance on Portland cement concrete, it also can be used on Portland cement concrete that remains moist throughout its lifetime due to lack of water drainage in the surrounding area.

In another embodiment the concrete has been poured and shaped from about 24 hours to about 48 hours before the polyurea composition, either as a one-part or a two-part composition, is applied to the area where the thermoplastic marking tile, preformed thermoplastic detectable warning devices, pavement markings and preformed traffic control devices will be placed. Longer periods than 48 hours are also applicable depending on the cure rate of the Portland cement concrete and the moisture content in the surrounding soil. Some concrete substrates remain moist throughout their lifetime due to lack of water drainage in the surrounding area.

In an embodiment within about 20 minutes of application of the surface preparatory moisture curable polyurea epoxy primer coating, or from about 1 minute to about 60 minutes depending on the ambient temperature, a coating of epoxy bonder paste adhesive is applied over the area where the polyurea epoxy primer composition is applied. The thermoplastic marking tile, preformed thermoplastic detectable warning device, pavement marking and preformed traffic control device was be laid over the area to which the epoxy bonder paste adhesive is applied.

In an embodiment the viscosity of the polyurea epoxy primer composition applied to the concrete is about 100 cP to about 300 cP.

In an embodiment the epoxy bonder paste had a thermoplastic adhesive applied over to which a thermoplastic marking tile, preformed thermoplastic detectable warning device, pavement marking and preformed traffic control device is applied to the thermoplastic adhesive.

In yet another embodiment the viscosity of the epoxy bonder paste composition applied to the epoxy primer is about 10,000 cP to about 300,000 cP.

DETAILED DESCRIPTION

The present disclosure relates to a method for adhering thermoplastic marking tile, preformed thermoplastic detectable warning devices, pavement markings and preformed traffic control devices (turn arrows, stop bars) that are hydrocarbon or alkyd thermoplastic in nature (generally known as thermoplastic signage) to an uncured concrete traffic surface to provide permanent pedestrian and traffic control markings. Traffic signage may be applied using this method preferably from about 24 hours to about 48 hours after pouring or shaping, although in many cases concrete may remain moist for longer periods due to the moisture content of the surrounding soil. In the present invention there is no need for preheating of the pavement, or removal of laitance on Portland cement concrete.

The present invention utilizes a low viscosity polyurea composition from about 100 cP to about 500 cP which allows rapid penetration into the pores of uncured concrete substrate surfaces. Without being bound by any particular theory, polyurea of the specified viscosity appears to penetrate through the moisture into the concrete substrate before curing.

The curative systems may also include amine-terminated chain extenders in the formulation. Suitable chain extenders include, but are not necessarily limited to aliphatic, aromatic and cycloaliphatic diamine chain extenders.

Polyurea compositions may be comprised of one-part, two-part or several component mixtures that may be premixed or blended on site and may remain in a liquid state (known as pot life) from seconds to days. Preferably the low viscosity polyurea composition will remain viable from about 1 minute to about 60 minutes.

In addition to polyurea compositions, other curable systems of a sufficiently low viscosity to penetrate the concrete surface are selected from the group comprising one- and two-part epoxies, multi-component polyurethanes, silicone adhesives, UV/EB curable adhesives, UV/EB curable resins and combinations thereof.

All Portland cements are hydraulic cements that set and harden through a chemical reaction with water. During this reaction, called hydration, a node forms on the surface of each cement particle. The node grows and expands until it links up with nodes from other cement particles or adheres to adjacent aggregates.

It is during hydration that an applied low viscosity polyurea seeps into and is chemically reactively bonded to the concrete. An adhesive, thermoplastic, or preformed thermoplastic sheeting is placed over the polyurea/concrete substrate The preferred epoxy bonder paste is a low modulus two component epoxy which is designed for application on horizontal, vertical, and overhead surfaces. Concrete surfaces may be dry or damp (not wet) and essentially free of all bond-inhibiting substances. The cleaned concrete surface should have a minimum strength of 250 psi in direct tension.

Mixing the two component epoxy system involves the resin to hardener (Part A:Part B) mix ratio of 2:1 by volume being mixed in an appropriate mixing container. Because pot life is always an issue with epoxy systems, it is important to begin mixing as quickly as possible and it is recommended that a Jiffy mixer blade at 350-750 rpm with an electric or pneumatic drill be utilized without the use of solvents or other thinning agents. The epoxy paste does not contain any VOC solvents and should be applied in a thickness of about ⅛ inch and should be allowed to cure at temperatures above 40 degrees F. The paste has excellent resistance to a wide range of commonly encountered chemicals specifically associated with aircraft and automobile fluids as well as cutting oils, etc.

Once mixed, the bonder paste has a preferred viscosity of 10,000 cP to 300,000 cP. The epoxy bonder paste is applied over the polyurea epoxy primer and either coated with a thermoplastic adhesive or preformed thermoplastic marking tile, preformed thermoplastic detectable warning device, pavement marking or preformed traffic control device. One purpose for employing the bonder paste is to bond the thermoplastic signage to the concrete surface which has previously been primed with the epoxy primer. The bonder paste also acts as a water vapor barrier to reduce the rate of water vapor transmission into the thermoplastic signage.

What is claimed is:

1. A system for coating a substrate and bonding a marking tile to said substrate, wherein a polyurea epoxy curable primer composition of about 200 centipoise comprises a sealing layer that is bonded directly to said substrate and, wherein said sealing layer bonds with an additional bonding layer comprising an epoxy bonder paste in a range of 10,000 to 300,000 centipoise, said wherein said sealing layer and said additional bonding layer provide a combined adhesive layer coating and covering of said substrate, wherein said substrate and said combined adhesive layer coating and covering provides for further bonding to a preformed thermoplastic marking tile that is applied over said additional bonding layer, thereby forming a single, semi-homogeneous, permanent pavement marking.

2. A system according to claim 1, wherein a thermoplastic adhesive is applied between adhesive coating and covering layer and said preformed thermoplastic marking tile and wherein adhesive coating and covering layer is acts as a water vapor barrier reducing the rate of water vapor transmission into said marking tile and wherein said water vapor barrier ensures adhesive longevity of said thermoplastic marking tile with said substrate.

3. A system according to claim 1, wherein said substrate comprises concrete that is uncured, partially cured or fully cured.

4. A system according to claim 1, wherein said substrate is concrete that has been previously shaped and formed within about 24 hours to about 2 weeks.

5. A system according to claim 4, wherein said concrete provides a moist, damp, or partially wet surface.

6. A system according to claim 1, wherein said substrate requires no laitance removal.

7. A system according to claim 1, wherein said thermoplastic marking tile is rolled, squeegeed, or formed, to substantially conform to a combined adhesive layer coating and covering said substrate.

8. A system according to claim 2, wherein said first substrate, adhesive coating and covering layer and said preformed thermoplastic marking tile chemically and/or physically react to form bonds with each other and with said substrate with or without the use of said thermoplastic adhesive.

9. A system according to claim 1, wherein said substrate is a traffic surface for pedestrians, motorized vehicles, aircraft, human powered conveyances, programmable robotics, men and/or machines.

10. A system according to claim 9, wherein said polyurea epoxy curable primer comprises a one part or multiple part composition or mixture and said mixture is a isocyanate-functional prepolymer, including terpene-phenolic resin, and a silane compound.

11. A system according to claim 10, wherein said polyurea epoxy curable primer comprises a one or two part epoxy, multi-component polyurethane, silicone adhesive, UV/EB curable adhesive, UV/EB curable resins, and/or combinations thereof.

12. A system according to claim 11, wherein said polyurea epoxy curable primer comprises a viscosity of about 10 centipoise to about 500 centipoise.

13. A system according to claim 10, wherein said polyurea epoxy curable primer remains uncured from about 1 minute to about 60 minutes.

14. A system according to claim 1, wherein said preformed thermoplastic marking tile comprises hydrocarbon based polymers.

15. A system according to claim 14, wherein said hydrocarbon based polymers are comprised of binders, resins, pigments, fillers and optionally reflective components.

16. A system according to claim 15, wherein said resins are comprised of maelic modified resin ester, C5 hydrocarbon, plasticizer, vegetable oils, phthalate esters, mineral oil, castor oil, wax/flexibilizer, paraffin wax, polyamide, EVA and/or SBS elastomers.

17. A system according to claim 15, wherein said pigments are comprised of titanium dioxide, lead chromate, and/or organic dyes.

18. A system according to claim 15, wherein said fillers are comprised of calcium carbonates.

19. A system according to claim 15, wherein said thermoplastic marking tile comprises alkyd polymers that are filled with of binders, resins, pigments, fillers and optionally reflective components.

20. A system according to claim 19, wherein said resins are comprised of maelic modified resin ester, rosin ester, plasticizer, vegetable oils, phthalate esters, mineral oil, castor oil, wax/flexibilizer, paraffin wax, polyamide, EVA and/or SBS elastomers.

21. A system according to claim 19, wherein said pigments are comprised of titanium dioxide, lead chromate and/or organic pigments.

22. A system according to claim 19, wherein said fillers are comprised of calcium carbonates.

23. A system according to claim 19, wherein said optional reflective components are comprised of glass beads.

24. A system according to claim 19, wherein said thermoplastic marking tile comprises detectable warning devices, pavement markings, and traffic control markings.

25. A system according to claim 19, wherein said thermoplastic marking tile is of a sheet, roll, flat, raised, strip or stripe form.

26. A system according to claim 7, wherein said thermoplastic marking tile conforms to AASHTO Designation M249-98 specifications.

* * * * *